US005619801A

United States Patent [19]

Slates

[11] Patent Number: 5,619,801

[45] Date of Patent: Apr. 15, 1997

[54] FIBER OPTIC PIN SIGHT FOR A BOW

[75] Inventor: Scott O. Slates, Wentzville, Mo.

[73] Assignee: Toxonics Manufacturing, Inc., Wentzville, Mo.

[21] Appl. No.: 494,946

[22] Filed: Jun. 26, 1995

[51] Int. Cl.[6] ..... F41G 1/467

[52] U.S. Cl. ..... 33/241; 33/265

[58] Field of Search ..... 33/265, 241; 124/87; 385/76, 77, 78, 81

[56] References Cited

U.S. PATENT DOCUMENTS

| | | | |
|---|---|---|---|
| Re. 31,515 | 2/1984 | Heldt | 385/78 |
| 802,277 | 10/1905 | Fric . | |
| 1,931,552 | 10/1933 | Maris . | |
| 2,155,169 | 4/1939 | Moses . | |
| 2,195,526 | 4/1940 | Traver . | |
| 2,504,115 | 4/1950 | Dickison . | |
| 3,121,163 | 2/1964 | Rickert . | |
| 3,184,851 | 5/1965 | Simmons . | |
| 3,284,904 | 11/1966 | Rade . | |
| 3,320,671 | 5/1967 | Rickert et al. . | |
| 3,582,638 | 6/1971 | Peters . | |
| 3,678,590 | 7/1972 | Hayward . | |
| 3,914,873 | 10/1975 | Elliott, Jr. et al. . | |
| 3,945,127 | 3/1976 | Spencer . | |
| 4,030,203 | 6/1977 | Ackerman, Jr. . | |
| 4,070,763 | 1/1978 | Carts, Jr. . | |
| 4,166,324 | 9/1979 | Carollo et al. . | |
| 4,170,071 | 10/1979 | Mann et al. . | |
| 4,177,572 | 12/1979 | Hindes | 33/265 |
| 4,220,983 | 9/1980 | Schroeder . | |
| 4,309,827 | 1/1982 | Larson . | |
| 4,400,887 | 8/1983 | Mason . | |
| 4,434,560 | 3/1984 | Comeyne . | |
| 4,535,747 | 8/1985 | Kudlacek . | |
| 4,603,942 | 8/1986 | Chang et al. . | |
| 4,846,141 | 7/1989 | Johnson | 33/265 |
| 4,928,394 | 5/1990 | Sherman . | |
| 4,953,302 | 9/1990 | Gould . | |
| 4,977,677 | 12/1990 | Troescher, Jr. . | |
| 5,086,567 | 2/1992 | Tutsch . | |
| 5,090,805 | 2/1992 | Stawarz . | |
| 5,122,932 | 6/1992 | Ziller . | |
| 5,148,603 | 9/1992 | Beutler . | |
| 5,157,839 | 10/1992 | Beutler . | |
| 5,174,269 | 12/1992 | Sappington | 33/265 |
| 5,201,124 | 4/1993 | Sherman . | |
| 5,231,765 | 8/1993 | Sherman . | |
| 5,418,874 | 5/1995 | Carlisle et al. | 385/76 |
| 5,435,068 | 7/1995 | Thames et al. | 33/265 |
| 5,442,861 | 8/1995 | Lorocco | 33/241 |

*Primary Examiner*—Thomas B. Will
*Attorney, Agent, or Firm*—Paul M. Denk

[57] ABSTRACT

A fiber optic pin sight includes a fiber optic cable holder which grips the cable to secure the cable in the sight. The cable holder includes a threaded shaft having a bore through which the cable extends. The shaft is chamfered or sloped at its back end and includes a slot which extends forwardly from the back end to define a pair of spaced apart flexible legs. The nut includes a tapered, internally threaded bore which receives the back end of the shaft. When the shaft is threaded into the nut, the legs are urged together to grip the cable.

8 Claims, 1 Drawing Sheet

FIBER OPTIC PIN SIGHT FOR A BOW

BACKGROUND OF THE APPLICATION

This invention relates to pin sights for bows, and in particular to a fiber optic pin sight.

Pin sights are often used with bows when hunting. As is known pin sights typically include a plurality of pins that are calibrated for certain distances, for example 15, 30, 50 and 100 yards. These pins are sighted on the target to obtain the proper trajectory for the arrow to be shot. In the past, the pins have typically been made of metal. However, some pin sights now use fiber optic pins. U.S. Pat. No. 5,231,765, for example, discloses such a sight.

Fiber optic cables are generally secured in place in a pin sight using a screw or the like which compresses the cable. When a fiber optic cable is compressed at a point, the cable can be damaged and the ability of the fiber optic cable to transmit light can thus be hindered. Obviously, if the cable is damaged and unable to transmit light efficiently, the pin sight will not be operable. On the other hand, if the cable is not securely set in the sight, it can accidentally be moved. The cables are calibrated to correspond to specific distances. If the cable is moved relative to its mount, the fiber optic cable will be out of calibration. This would be true even if the cable's mount did not move. It is therefore desirable to firmly hold the cable in place without unduly compressing the fiber optic cable.

SUMMARY OF THE INVENTION

One object of the present invention is to provide a fiber optic pin sight.

Another object is to provide such a pin sight in which the fiber optic cable of the pin sight is securely held in place.

Another object is to provide such a bow sight which will not damage the fiber optic cable.

Another object is to provide such a pin sight in which the fiber optic cable is clamped along a portion of its length, rather than being compressed at a single point, to secure the fiber optic cable in the bow sight.

Another object is to provide such a bow sight in which the cable is easily replaced if necessary.

These and other objects will become apparent to those skilled in the art in light of the following disclosure and accompanying drawings.

In accordance with the invention, generally stated, a fiber optic pin sight which is mountable to a bow. The sight includes a mounting plate which is operatively securable to the bow, a plurality of pin mounting blocks secured to the mounting plate, a fiber optic cable holder secured to each of the pin mounting blocks, and a fiber optic cable extending through and secured in the cable holder. The cable holder includes an eternally threaded shaft defining a shaft bore and a compression nut defining a threaded nut bore. The cable extends through the shaft bore. The shaft has a front end and a back end, an outer diameter which is substantially constant along the length of the shaft, and a slot extending forwardly from the back end to define two spaced apart legs. The outer diameter of the shaft is slopingly reduced at the back of the shaft. The slot is sufficiently long so that said legs are slightly flexible, and can grip the cable. The nut bore has a tapered section which reduces the diameter of the nut bore from a diameter that the shaft can be threaded through to a smaller diameter. As the shaft is threaded into the nut, and as the slit portion of the shaft is introduced into the tapered section of the nut bore, the nut brings the shaft legs together such that the legs grip the said fiber optic cable. Preferable, the nut bore has three sections: a threaded section of constant diameter, the tapered section, and a third section which receives the nose of the shaft. The third section has a diameter slightly larger than the end of the shaft nose and smaller than the diameter of the main part or body of the shaft.

The shaft is preferably made of brass. To enable the legs to be sufficiently flexible, the slot a length approximately 1.6–1.8 times the outer diameter of the shaft. The nut bore preferably does not extend all the way through the nut. The sight preferably includes a generally U-shaped guard which surrounds the fiber optic pins.

DESCRIPTION OF THE PREFERRED EMBODIMENT

Figure 1:
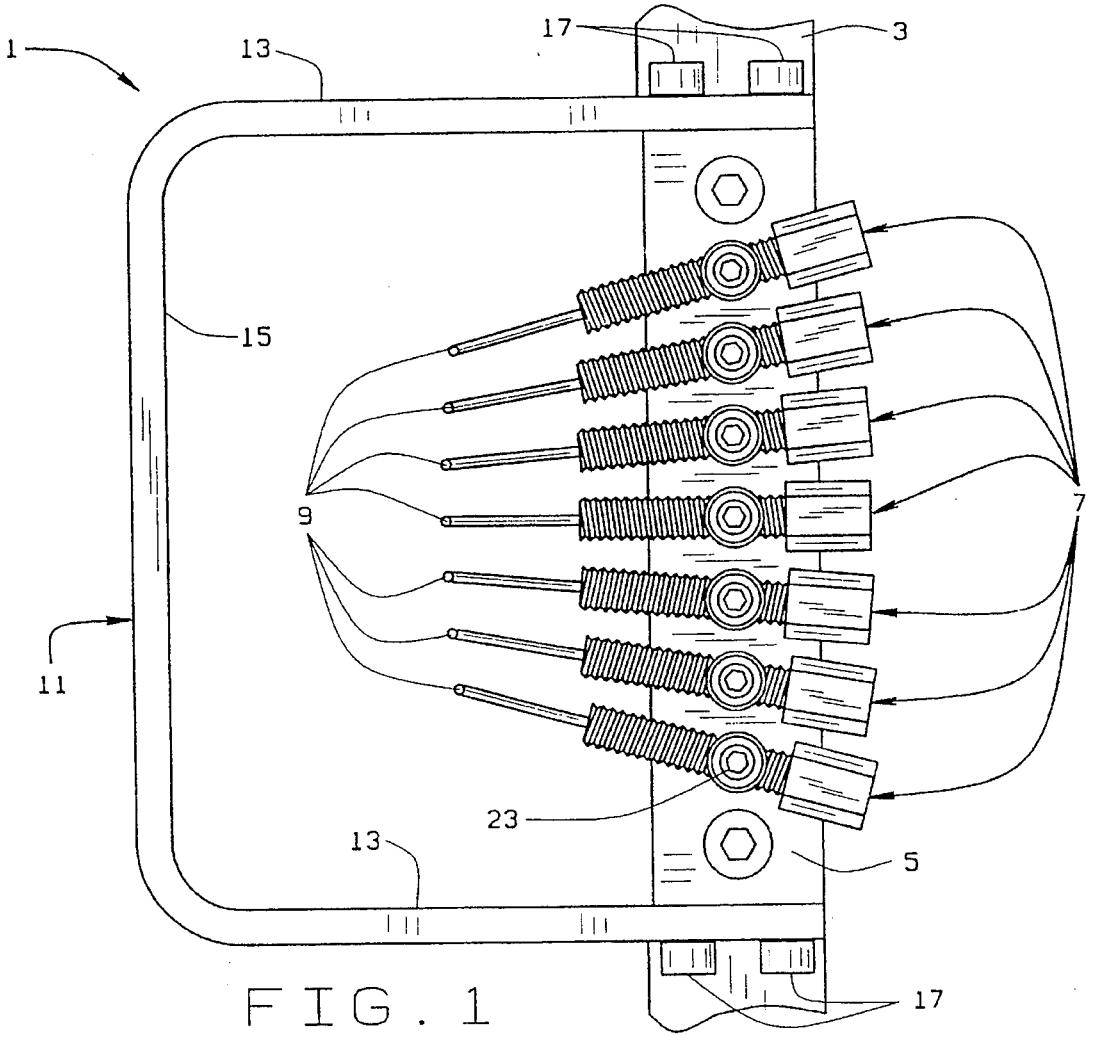
FIG. 1 is an elevational view of a pin sight of the present invention mounted on a bow.

Referring initially to FIG. 1, a sight 1 of the present invention is shown secured to a bow 3. The sight includes a mounting plate 5 which may be secured to the bow in any conventional manner. A plurality of pin assemblies 7 are secured to the mounting plate 5 and have fiber optic cables 9 which extend across the archer's line of sight so that the fiber optic cables 9 operate as the pins of the sight. Fiber optic cables are flexible and can be somewhat fragile. To protect the cables 9 from damage, a generally U-shaped guard 11 surrounds the cables 9. The guard 11 includes upper and lower legs 13 which extend from the mounting plate 5 in the plane of the cables 9. A plate or web 15 extends between the legs 13 in front of the cables 9. The guard 11 is secured to the mounting plate 5 using screws 17 which extend through the legs 13 into the top and bottom surfaces of the mounting plate 5. The guard 11 preferably is sufficiently wide so that the legs 13 and web 15 are wider than pin assemblies 7. The cables 9 will therefore be protected against damaged if the sight 1 is accidentally brushed against a bush, tree, etc.

Figure 2:
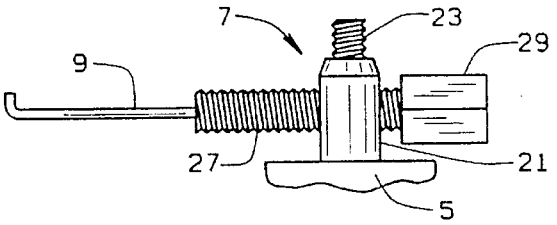
FIG. 2 is a side view of a mounting block in which a fiber optic pin or cable is mounted.
Figure 3:
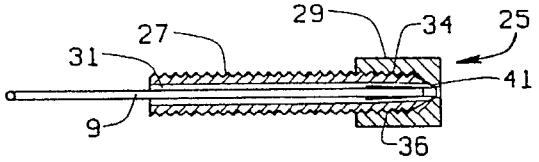
FIG. 3 is a cross-sectional view of a holder which receives the fiber optic cable.
Figure 4:
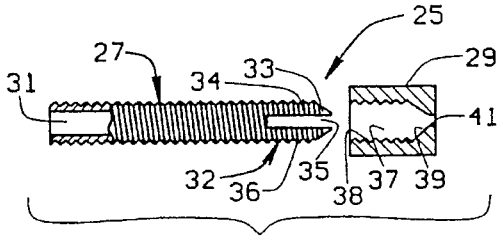
FIG. 4 is an exploded view of the holder, partly in cross-section.

A pin assembly 7 is shown in more detail in FIGS. 2-4. The pin assemblies 7 are identical. Thus only one pin assembly is described. The pin assembly 7 includes a mount 21 which is secured to the mounting plate 5, for example by screw 23 which extends through the mount. A cable holder 25 extends through the mount 21 to secure the cable 9 in the sight 1. The mount 21 has an internally threaded opening and the cable holder 25 has an externally threaded member. The holder 25 is thus screwed into the mount 21.

The cable holder 25 includes an externally threaded shaft 27 and a compression nut 29. It is the shaft 27 that is screwed into the mount 21 to secure the holder 25 to the mount 21. The shaft 27 is hollow and defines a smooth bore 31 sized to receive the fiber optic cable 9. The bore 31 has a diameter slightly larger than the cable 9 so that the cable may be easily slid into the shaft 27. As will become clear, this makes assembly of the pin assembly 7 easy and allows for easy replacement of the cable, should replacement be necessary. The shaft 27 is chamfered or beveled as at 33, to make the back end 32 of the shaft slightly pointed. The shaft however does not come to a sharp point at its end. A slot 35 is also formed at the back end 32 of the shaft to define two spaced apart legs 34 and 36. The slot 35 extends forwardly from the end 32 of the shaft a distance sufficiently long to make the legs 34 and 36 slightly flexible. The legs 34 and 36 may thus be pushed together to reduce the diameter of the portion of the bore 31 which extends through the legs. This enables the legs to clamp down on the cable 9 without compressing the cable 9 to the point of potentially damaging the cable. The slot 35 preferably is about ¼" long, which is approximately 1.8 times the diameter of the shaft.

The compression nut 29 defines an internally threaded bore 37 which does not extend the full length of the nut 29. Rather, it extends form an opening 38 at the front surface of the nut to a point which is short of the back surface of the nut. A bore 41 of narrower diameter extends from the back surface of the nut to the bore thread 37. The bore 41 and the bore 37 are joined by a tapered section 39. The hole or bore 41, although smaller than the bore 31, is slightly larger in diameter than the back of 32 of shaft 27.

In use, the cable 9 is threaded into the shaft such that the cable extends at least through the back end of the shaft, and preferably extends out the back end of the shaft. A short portion of the fiber optic cable 9, at the front thereof, is turned 90° to extend toward the archer so that the archer can see the lighted tip of the cable 9 for improved sighting. Obviously, a portion of the cable 9 will extend out the front of the shaft to act as the pin of the sight. The nut is then screwed about the shaft 27 or the shaft is screwed into the nut, with the back end of the shaft being received in the nut. The opening 38 of the nut bore 37 is sized so that the back, tapered end 32 of the shaft will fit into the nut, however, the front end of the shaft will not. When the shaft 27 is threaded into the nut, the tapered end 32 of the shaft reaches the tapered portion 39 of the nut. Upon threaded the shaft further into the nut, the tapered end 32 of the shaft is forced through the tapered portion 39 of the nut. The slit 35 of the shaft allows the legs 34 and 36 of the shaft to come together, and the tip 33 of the shaft enters the hole or bore 41. When the tip of the shaft enters bore 41, the legs of the shaft come together, as just stated, and the threads at the end 32 of the shaft separate from the threads of the nut. Further, the inner surfaces of the legs 34 and 36 grip the cable 9. The grip of the legs on the cable secures the cable in holder 7, and hence sight 1, without damaging the cable. Hence the ability of the cable to transmit light is not affected.

The cable 9 can be inserted in the holder 25 before or after the shaft 27 has been screwed into the mount 21, and before or after the mount has been secured to the mounting block 5. As seen from FIG. 1, the holder 25 is inserted in mount 21 so that the nut 29 is outside of the guard 11 and that the front end of the shaft 27 extends into the area defined by the guard 11. If necessary, the cable 9 can be replaced simply by loosening the nut 29 on the shaft 27 an amount sufficient to loosen the grip of legs 34 and 36 on the cable. The cable 9 can then be removed and easily replaced with an new cable.

As variations within the scope of the appended claims may be apparent to those skilled in the art, the foregoing description is set forth only for illustrative purposes and is not meant to be limiting. For example, although the mount 21 is shown to be generally cylindrical, it could be a generally rectangular block, or any other desired shape. The mount 21 can be mounted to the mounting block 5 to be pivotal relative to the mounting block in the plane of the cables 9, or to be slidable axially along the mounting block, or combinations thereof. Rather than the nut having a short tapered section in the nut, the nut can have a tapered section that is the length of the shaft legs. This will keep the shaft threads in meshing contact with the nut threads over the length of the nut bore. These examples are merely illustrative.

I claim:

1. A fiber optic pin sight, the pin sight being mountable to an archery bow, the pin sight including:

a mounting plate which is operatively secured to a bow, a plurality of pin mounting blocks secured to the mounting plate, a fiber optic cable holder secured to each of said plurality of mounting blocks, and a fiber optic cable extending through and secured in the cable holder, the cable holder gripping the fiber optic cable along a portion of the cable, the fiber optic cable holder includes an externally threaded shaft defining a shaft bore and a compression nut defining a nut bore, said cable extending through said shaft bore, the shaft having a front end and a back end, the shaft having an outer diameter which is substantially constant along the length of the shaft, the outer diameter being slopingly reduced at the back end of said shaft, said shaft further including a slot extending forwardly from said back end of said shaft to define two spaced apart legs, said slot being sufficiently long such that said legs are slightly flexible, the nut bore having three sections, a first threaded section of substantially constant diameter which extends a majority of the length of the nut, a second tapering section, and a third section of constant diameter which extends from the tapered section to the back surface of the nut, the third section having a diameter slightly larger than the diameter of the shaft at the back thereof, but smaller than the constant diameter of the shaft, wherein as said nut is screwed over said shaft, the tapered section of the shaft is introduced into the tapered section of the nut and into the third portion of the nut bore bringing said shaft legs together such that said legs tightly grip said fiber optic cable and resists its movement once adjusted and when subjected to extensive forces during usage of the archery bow.

2. The fiber optic pin sight of claim 1 wherein said cable holder shaft is threadedly secured in said pin mounting block.

3. The fiber optic pin sight of claim 2 wherein said pin mounting block is threadedly secured to said mounting plate.

4. The fiber optic pin sight of claim 2 wherein said sight includes a guard surrounding said fiber optic cables to protect said fiber optic cables, said guard being generally U-shaped and including an upper leg extending from a top surface of said mounting plate, a lower leg extending from a lower surface of said mounting plate, and a web extending between said upper and lower legs; said guard being extending in the plane of said fiber optic cables and being sufficiently wide to protect said fiber optic cables.

5. A holder for holding a fiber optic cable in a fiber optic pin sight for an archery bow, said holder including a shaft defining a shaft bore and a compression nut defining a threaded nut bore, said fiber optic cable extending through said shaft bore, said shaft having a front end and a back end, a shaft body that is at least partially threaded, said shaft body being of substantially constant diameter, a nose at an end of said shaft body, said nose being tapered, a slot extending forwardly from said nose and into said shaft body to define two spaced apart legs, said slot being sufficiently long such that said legs are slightly flexible, the nut bore having a tapered section, wherein as said shaft legs are introduced into said tapered section of said nut, said nut compresses said shaft legs together such that said legs grip said fiber optic cable, said shaft bore having three sections, a first threaded section of substantially constant diameter, said tapered section extending forwardly of said threaded section, and a third section of substantially constant diameter, said threaded section extending a majority of the length of said nut, said third section having a diameter larger than a diameter of said shaft nose at an end thereof and smaller than a diameter of said shaft body, said slot of the shaft body having a length approximately 1.7 times the outer diameter of said shaft, whereby upon threading of said shaft within the compression nut to tighten about the fiber optic cable, the nose of the shaft body extends into and through the tapered section of said nut to disengage the proximate threaded engagement of the shaft body with the compression nut and forcing the shaft body legs to grip and hold said fiber optic cable of the pin sight after its setting.

6. The holder of claim 5 wherein said shaft is made of brass.

7. The holder of claim 5 wherein said threaded nut bore ends short of a back surface of said nut, said nut defining a hole extending from said back surface to said nut bore, said nut defining a step at an intersection of said hole and said nut bore.

8. The holder of claim 7 wherein said hole in said nut has a diameter approximately equal to the outer diameter of said shaft at said back of said shaft.

* * * * *